US010974116B2

(12) United States Patent
Jin

(10) Patent No.: US 10,974,116 B2
(45) Date of Patent: Apr. 13, 2021

(54) GOLF CLOTHING FOR CORRECTING SWING POSTURE

(71) Applicant: GREENTOO CONSULTANT COMPANY, Beijing (CN)

(72) Inventor: Xuesong Jin, Beijing (CN)

(73) Assignee: GREENTOO CONSULTANT COMPANY, Beijing (CN)

( * ) Notice: Subject to any disclaimer, the term of this patent is extended or adjusted under 35 U.S.C. 154(b) by 0 days.

(21) Appl. No.: 16/470,210

(22) PCT Filed: Dec. 27, 2016

(86) PCT No.: PCT/CN2016/112326
§ 371 (c)(1),
(2) Date: Jun. 15, 2019

(87) PCT Pub. No.: WO2018/107519
PCT Pub. Date: Jun. 21, 2018

(65) Prior Publication Data

US 2020/0016468 A1 Jan. 16, 2020

(30) Foreign Application Priority Data

Dec. 16, 2016 (CN) ..... 2016 1 1166823

(51) Int. Cl.
*A63B 69/36* (2006.01)
*A63B 69/00* (2006.01)
(Continued)

(52) U.S. Cl.
CPC ..... *A63B 69/0059* (2013.01); *A41D 13/0015* (2013.01); *A63B 57/10* (2015.10); *A63B 2209/10* (2013.01)

(58) Field of Classification Search
CPC . A63B 69/0059; A63B 57/10; A63B 2209/10; A63B 69/3623; A63B 2209/00;
(Continued)

(56) References Cited

U.S. PATENT DOCUMENTS 1,699,219 A * 1/1929 Bemish ..... A63B 69/0059 473/212
2,468,580 A * 4/1949 Weis ..... A63B 69/0059 473/214
(Continued)

FOREIGN PATENT DOCUMENTS

CN 2683206 Y 3/2005
CN 203913415 U 11/2014
(Continued)

*Primary Examiner* — Nini F Legesse

(57) ABSTRACT

A golf clothing for correcting a swing posture in golf sports is disclosed, which includes a clothing body (1) and an auxiliary structure for correcting swing posture provided on the clothing body, wherein: the auxiliary structure for correcting swing posture enables a player (5) to keep a shape formed by both arms and shoulders of the player as a triangular shape during a swing process. Through the auxiliary structure for correcting swing posture, the present invention is able to correct the swing posture of the player (5), especially the beginner, so that the player (5) is able to grasp the correct swing posture as soon as possible, thereby quickly improving the golf level and the sports experience.

5 Claims, 8 Drawing Sheets

(51) Int. Cl.
*A63B 57/10* (2015.01)
*A41D 13/00* (2006.01)

(58) Field of Classification Search
CPC ..... A63B 2208/02; A63B 2071/0694; A63B 69/36; A41D 13/0015; A41D 2300/322; A41D 27/10; A41D 2300/20; A41D 1/04; A41D 27/08; A41D 1/00; A41D 27/00
USPC ..... 473/205, 206, 212, 215, 219, 229, 266, 473/276, 277
See application file for complete search history.

(56) References Cited

U.S. PATENT DOCUMENTS 3,106,718 A * 10/1963 Raab ..... A41D 13/08 473/214
4,890,841 A * 1/1990 Brooks ..... A63B 69/0059 473/212
5,096,199 A * 3/1992 Wyatt, Jr. ..... A63B 21/00069 473/212
5,795,238 A * 8/1998 Nicholson ..... A63B 69/0059 473/213
5,839,122 A * 11/1998 Dicker ..... A63B 21/4019 2/67
5,978,966 A * 11/1999 Dicker ..... A63B 21/4017 2/69
6,126,554 A * 10/2000 Poscente ..... A63B 69/0059 473/212
7,033,284 B2 * 4/2006 Yoshimura ..... A63B 69/3608 473/212
7,117,538 B2 * 10/2006 Bosne ..... A41D 3/00 2/93
7,976,398 B2 * 7/2011 Clawson ..... A63B 69/0059 473/212
7,985,144 B1 * 7/2011 Gonzales ..... A41D 13/0015 2/93
9,061,195 B1 * 6/2015 Collins ..... A63B 69/0059
2008/0026863 A1 * 1/2008 Eck ..... A63B 69/3623 473/212

FOREIGN PATENT DOCUMENTS

CN 203916010 U 11/2014
JP 4084407 B1 4/2008
KR 20090012003 U 11/2009
KR 101286957 B1 7/2013

* cited by examiner

GOLF CLOTHING FOR CORRECTING SWING POSTURE

CROSS REFERENCE OF RELATED APPLICATION

This is a U.S. National Stage under 35 U.S.C. 371 of the International Application PCT/CN2016/112326, filed Dec. 27, 2016, which claims priority under 35 U.S.C. 119(a-d) to CN 201611166823.7, filed Dec. 16, 2016.

BACKGROUND OF THE PRESENT INVENTION

Field of Invention

The present invention relates to a clothing worn during golf, and more particularly to a golf clothing for correcting a swing posture in golf sports.

Description of Related Arts

With the improvement of people's quality of life, more and more people choose golf. On the one hand, fitness is achieved through sports; on the other hand, the golf course has a beautiful environment and wide vision, which makes urban people engaged in high-pressure work relax to achieve self-cultivation. However, golf is a highly demanding sport that requires the player to master the swing skills to effectively shoot the ball into the cave. In order to effectively and accurately keep the swing action, many players choose auxiliary parts to limit the movement of the body, such as straps that are placed on the arm to limit the movement of the arm. However, this auxiliary part makes the exercise uncomfortable and the comfort is poor, so that the experience of the exercise by relaxing the body is degraded.

Therefore, there is an urgent need for a clothing worn during golf which is able to correct the swing posture without reducing the comfort of the exercise.

SUMMARY OF THE PRESENT INVENTION

Aiming at the above technical problem, the present invention provides a golf clothing for correcting swing posture in golf sports.

A technical solution of the present invention is as follows.

Embodiments of the present invention provide a golf clothing for correcting a swing posture comprises a clothing body and an auxiliary structure for correcting swing posture provided on the clothing body, wherein: the auxiliary structure for correcting swing posture enables a player holding a golf club with double fists for regular hitting to keep a shape formed by both arms and shoulders as a triangular shape during a swing process.

Preferably, the triangular shape is an approximate isosceles triangular shape.

Preferably, the auxiliary structure for correcting swing posture comprises a strip identification part, wherein the strip identification part comprises a shoulder identification section and a double-arm identification section, the shoulder identification section transversely extends from a front side of a shoulder section of the clothing body, the double-arm identification section comprises a left-arm identification subsection and a right-arm identification subsection both of which are respectively connected with two sides of the shoulder identification section and respectively extend along two sleeves of the golf clothing, in such a manner that when the player holds the golf club with double fists and performs a regular hitting preparation posture, a shape which is formed by the shoulder identification section and the double-arm identification section and seen from a perspective of the player is an approximate triangular shape.

Preferably, the strip identification part has a significantly distinguishing color or pattern which is significantly different from the part on the clothing body other than the strip marking part.

Preferably, the strip identification part is formed by printing on the clothing body; or the strip identification part is formed independent from the clothing body and then installed to the clothing body.

Preferably, the auxiliary structure for correcting swing posture comprises a connection structure, wherein: the connection structure is able to be repeatedly separated and combined, and comprises a left-arm connection substructure and a right-arm connection substructure each of which comprises a connecting piece and a connected piece, wherein: the left-arm connection substructure is located between an inner side of a left-arm sleeve section and a left side of a chest section of the clothing body, such that the inner side of the left-arm sleeve section tightly clings to the left side of the chest section of the clothing body when the connecting piece and the connected piece of the left-arm connection substructure are connected with each other; the right-arm connection substructure is located between an inner side of a right-arm sleeve section and a right side of the chest section of the clothing body, such that the inner side of the right-arm sleeve section tightly clings to the right side of the chest section of the clothing body when the connecting piece and the connected piece of the right-arm connection substructure are connected with each other; so that when the player swings after wearing the golf clothing with the connection structure, due to a limitation of the connection structure, two arms of the player are not easy to bend, thus the shape formed by the both arms and the shoulders of the player keeps the triangular shape.

Preferably, the connection structure is a zipper structure.

Preferably, the zipper structure comprises two zipper belts which are mated to each other and a slide element connecting the two zipper belts with each other, wherein: a zipper belt located at an inner side of a sleeve section of the clothing body extends from an underarm section to an elbow section of the clothing body, and a zipper belt located at a chest section of the clothing body extends from the under arm section to the chest section in a tilt manner.

Preferably, the auxiliary structure for correcting swing posture comprises an elbow joint inhibition structure which is located at an inner side of a left-elbow section of the clothing body and/or an inner side of a right-elbow section of the clothing body, wherein: the elbow joint inhibition structure comprises an insertion part and a rod-shaped hard object to inhibit an elbow joint of the player from bending, the hard object is detachably inserted into the insertion part, such that when the hard object is inserted into the insertion part on a hitting target-side arm of the player, the hard object limits the elbow joint of the player to bend for remaining the arm straight, thus a shape formed by the both arms and the shoulders of the player always remains a triangular shape.

Preferably, the hard object is a golf nail.

The present invention provides a golf clothing for correcting a swing posture in golf sports, the golf clothing comprises an auxiliary structure for correcting swing posture which comprises a strip identification part continuously formed at two shoulder sections and two arm sections of the clothing body; by observing the shape of the identification part by the naked eye during the swing process, the player is able to easily confirm and keep the correct posture such as the shoulders and the arms forming an approximate isosceles triangular shape, and the left arm straightening, which facilitates the correct swing. The present invention is able to correct the swing posture of the player, especially the beginner, so that the player is able to grasp the correct swing posture as soon as possible, thereby quickly improving the golf level and the sports experience.

DETAILED DESCRIPTION OF THE PREFERRED EMBODIMENT

The present invention will be further described in detail with accompanying drawings as follows.

The present invention provides a golf clothing for correcting a swing posture in golf sports, wherein an auxiliary structure for correcting swing posture is set on a clothing body and comprises a strip identification part which is continuously formed at two shoulder sections and two arm sections of the clothing body; by observing the shape of the identification part by the naked eye during the swing process, the player is able to easily confirm and keep the correct posture such as the shoulders and the arms forming an approximate isosceles triangular shape, and the left arm straightening, which facilitates the correct swing. The present invention is able to correct the swing posture of the player, especially the beginner, so that the player is able to grasp the correct swing posture as soon as possible, thereby quickly improving the golf level and the sports experience. The approximate isosceles triangular shape herein is generally similar to an isosceles triangular shape, and is not a geometrically defined isosceles triangular shape.

In the present invention, the golf clothing for correcting the swing posture comprises a clothing body 1 and an auxiliary structure for correcting swing posture provided on the clothing body 1; the auxiliary structure for correcting swing posture enables a player holding a golf club with double fists for regular hitting to keep a shape formed by both arms and shoulders of the player in a triangular shape during a swing process. The present invention has no specific limitation on the specific implementation structure of the auxiliary structure for correcting swing posture, as long as the shape formed by the both arms and the shoulders of the player is kept in an approximate isosceles triangular shape. In some preferred embodiments of the present invention, the auxiliary structure for correcting swing posture comprises at least one of the strip identification part, the connection structure and the elbow joint inhibition structure. Hereinafter, these preferred embodiments are described with accompanying drawings as follows.

First Embodiment

Figure 1:
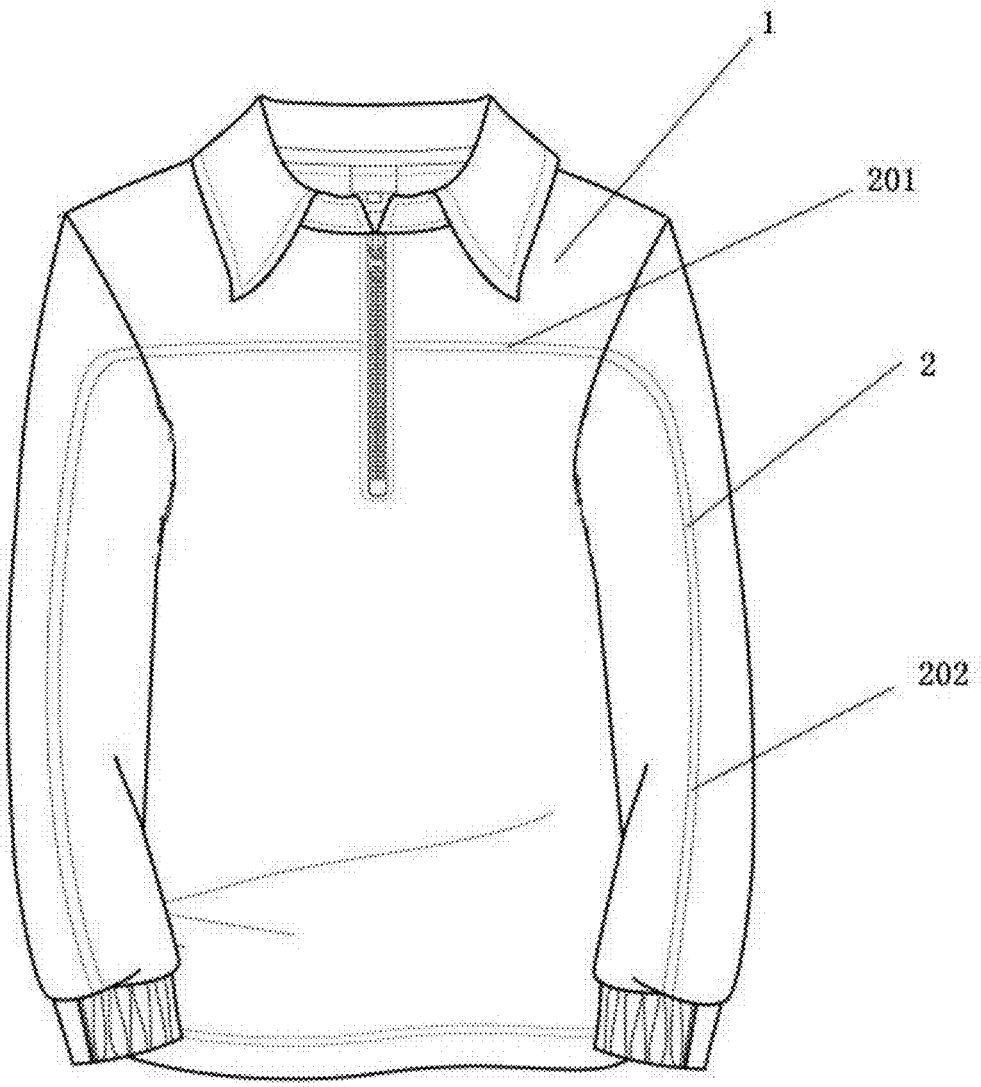
FIG. 1 is a structurally schematic view of a golf clothing with an identification part according to a first embodiment of the present invention.

Identification Part:

FIG. 1 is a structurally schematic view of a clothing according to a first embodiment of the present invention. Referring to FIG. 1, a golf clothing for correcting swing posture in golf sports according to the first embodiment of the present invention is illustrated, which comprises a clothing body 1 and an auxiliary structure for correcting swing posture provided on the clothing body 1. According to the first embodiment of the present invention, the auxiliary structure for correcting swing posture is embodied as a strip identification part 2, and the identification part 2 comprises a shoulder identification section 201 and a double-arm identification section 202, wherein: the shoulder identification section 201 transversely extends from a front side of a shoulder section of the clothing body 1, the double-arm identification section 202 comprises a left-arm identification subsection and a right-arm identification subsection both of which are respectively connected with two sides of the shoulder identification section and respectively extend along two sleeves of the golf clothing; when a player holds a golf club with double fists and performs a regular hitting preparation posture, a shape which is formed by the shoulder identification section and the double-arm identification section and seen from a perspective of the player is an approximate triangular shape. Preferably, the strip identification part has a significantly distinguishing color or pattern which is significantly different from the clothing body, namely, when the player holds the golf club with double fists to hit, the strip identification part is able to form a striking triangular shape. In the present application, there is no limitation on the specific embodiment of the color and the pattern, as long as the strip identification part is able to be seen through the color and the pattern. For example, the color may be a single color or a mixed color, and the pattern may be a triangular pattern. Preferably, the strip identification part is form by printing on the clothing body; or the strip identification part is formed independent from the clothing body and then installed to the clothing body.

Figure 9:
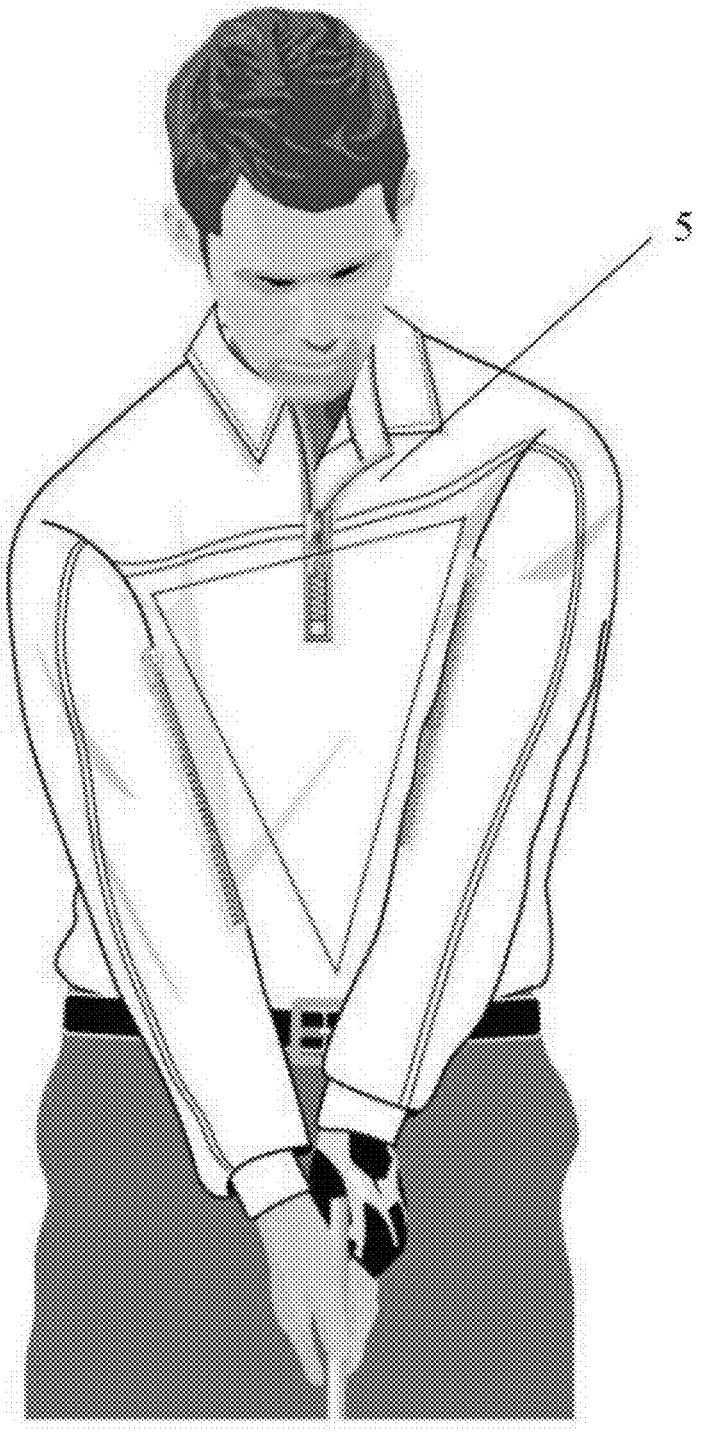
FIG. 9 shows that a player wears a golf clothing provided by the present invention for swing.

In the present application, when the player performs a regular hitting, namely, when the player naturally lowers his or her head, attaches an upper part of the double arms to a front side of a body, and holds the golf club with double fists for swing, the shoulder identification section 201 and the double-arm identification section 202 of the strip identification part 2 form an approximate isosceles triangular shape. Since the color or the pattern of the strip identification part 2 is significantly from other parts of the golf clothing, the player 5 is able to see the strip identification part 2 through an angle of view (or split vision) during a swing process, which means that the strip identification part 2 defines a striking triangular shape, so that shoulders and double arms of the player keep an approximate isosceles triangular shape through referring to the triangular shape formed by the strip identification part 2, so as to further keep a standard swing posture, as shown in FIG. 9. In other words, during the swing process, if the strip identification part 2 or a subpart of the strip identification part on the player 5 is unable to be seen, it means that the swing posture of the player is not accurate and needs to be adjusted.

Second Embodiment

Figure 2:
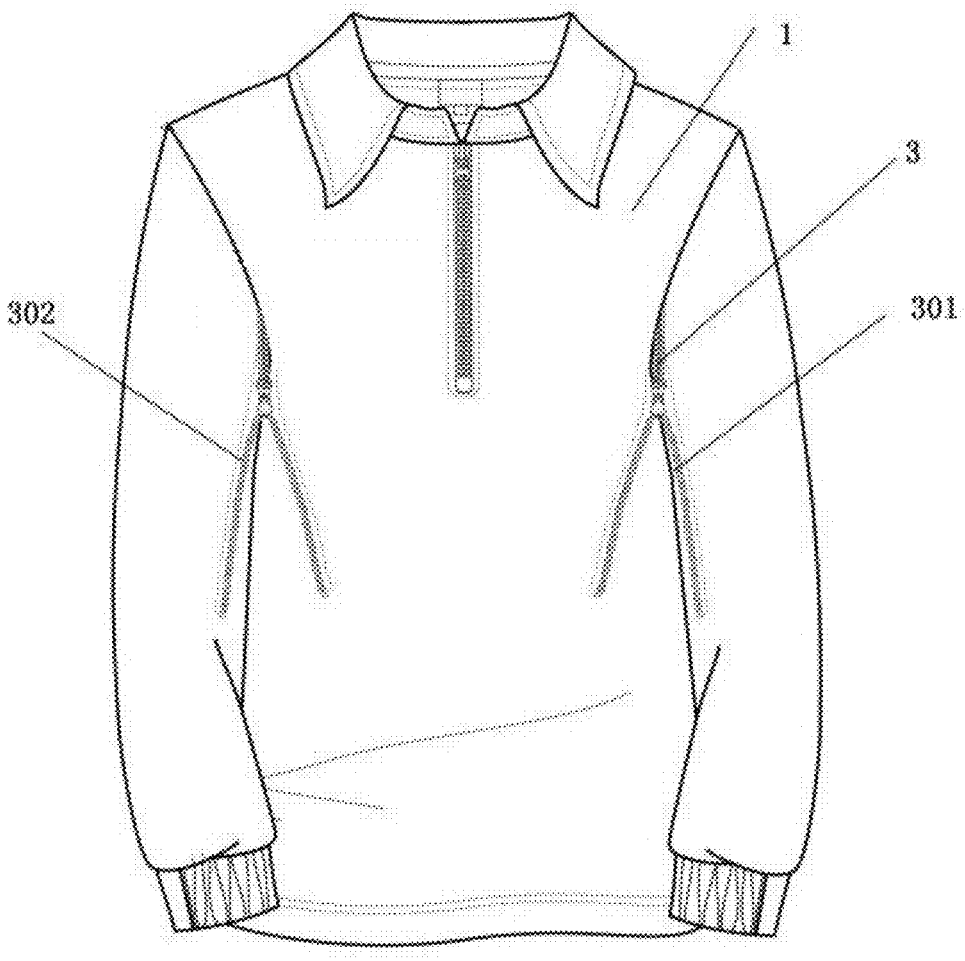
FIG. 2 is a structurally schematic view of a golf clothing with a connection structure according to a second embodiment of the present invention.

Connection Structure:

FIG. 2 is a structurally schematic view of a clothing according to a second embodiment of the present invention. Referring to FIG. 2, a golf clothing for correcting swing posture in golf sports according to the second embodiment of the present invention is illustrated, which comprises a clothing body 1 and an auxiliary structure for correcting swing posture provided on the clothing body 1. According to the second embodiment of the present invention, the auxiliary structure for correcting swing posture is embodied as a connection structure 3. As shown in FIG. 2, the connection structure 3 is provided on the clothing body 1 and is able to be repeatedly separated and combined. Specifically, the connection structure 3 is able to be set at positions of the clothing body as follows. When a player wearing a golf clothing holds a golf club with double fists and performs a regular hitting, the connection structure is set at connection locations where arms of the player contact with a chest of the player; that is to say, referring to the player 5 wearing the golf clothing, when the player 5 performs the regular hitting, the arms of the player 5 are placed against the chest of the player 5, which means that there are interconnected connection locations which are respectively located at arm sections and a chest section of the clothing body, hereinafter, for the sake of simplicity, a connection location on an arm section of the clothing body 1 is referred to as a first connection location, and a connection position on a chest section of the clothing body is referred to as a second connection location; at this time, the first connection location extends from an underarm section of the clothing body in a tilted manner to the chest section of the clothing body, the second connection location extends from the underarm section of the clothing body to an elbow section of the clothing body, as shown in FIG. 2. In more detail, the connection structure 3 comprises a left-arm connection substructure 301 and a right-arm connection substructure 302 each of the left-arm connection substructure 301 and the right-arm connection substructure 302 comprises a connecting piece and a connected piece, wherein: the left-arm connection substructure 301 is located between an inner side of a left-arm sleeve section and a left side of the chest section of the clothing body 1, such that the inner side of the left-arm sleeve section tightly clings to the left side of the chest section of the clothing body when the connecting piece and the connected piece of the left-arm connection substructure 301 are connected with each other; the right-arm connection substructure 302 is located between an inner side of a right-arm sleeve section and a right side of the chest section of the clothing body, such that the inner side of the right-arm sleeve section tightly clings to the right side of the chest section of the clothing body when the connecting piece and the connected piece of the right-arm connection substructure are connected with each other. When the player swings after wearing the golf clothing with the connection structure, due to the limitation of the connection structure 3, two arms of the player are not easy to bend, so that the both arms and the shoulder of the player keep a triangular shape, as shown in FIG. 9, so as to further keep the swing posture.

The present invention has no specific limitation on the connection structure, as long as the connection structure is able to ensure that shoulders and arms of the player form an approximate isosceles triangular shape during the swing process of the player 5. In a preferred example, the connection structure 3 is embodied as a zipper structure with simple and easy operation. However, the present invention is not limited thereto. For example, it is not exhaustive, and may be an adhesive structure which is connected by bonding, or a button structure which is connected by a button fastening method, or a snap structure which is connected by a snap fastening method. When the connection structure 3 is embodied as the zipper structure, the zipper structure comprises a first zipper belt, a second zipper belt and a slide element connecting the first zipper belt with the second zipper belt, wherein: when the slide element is pulled to connect the first zipper belt with the second zipper belt, the both arms and the chest of the player who does the regular hitting are connected, so as to prevent the shoulders and the arms of the player from moving, so that the shoulders and the arms of the player form an approximate isosceles triangular shape during the swing process. The first zipper belt of the zipper structure is located at the first connection location or the second connection location, the second zipper belt of the zipper structure is corresponding located at the second connection location or the first connection location. When the connection structure 3 is embodied as the adhesive structure, the adhesive structure is a magic sticker, in such a manner that, a female button of the magic sticker is located at the first connection location, and a male button of the magic sticker is located at the second connection location. However, the present invention is not limited thereto. The female button of the magic sticker is also able to be located at the second connection location, and the male button of the magic sticker is also able to be located at the first connection location. An amount of the female buttons and the male buttons is determined as required, and is able to be 3 to 5. In order to prevent the magic sticker from sticking together when the golf clothing is not used, a cover is provided to covering the female button or the male button. Through bonding the female button and the male button, the both arms and the chest of the player who does the regular hitting are connected, so as to prevent the shoulders and the arms of the player from moving, so that the shoulders and the arms of the player form an approximate isosceles triangular shape during the swing process. When the connection structure is embodied as the button structure, the connection structure comprises a button located at the first connection location or the second connection location, and a button hole which is correspondingly located at the second connection location and the first connection location. An amount of the buttons and the button holes is determined as required, and is able to be 3 to 5. Through fastening the button and the button hole, the both arms and the chest of the player who does the regular hitting are connected, so as to prevent the shoulders and the arms of the player from moving, so that the shoulders and the arms of the player form an approximate isosceles triangular shape during the swing process. When the connection structure is embodied as a snap structure, the connection structure comprises a male snap-button located at the first connection location or the second connection location, and a female snap-button which is correspondingly located at the second connection location or the first connection location. An amount of the male snap-buttons and the female snap-buttons is determined as required, and is able to be 3 to 5. Through fastening the male snap-button and the female snap-button, the both arms and the chest of the player who does the regular hitting are connected, so as to prevent the shoulders and the arms of the player from moving, so that the shoulders and the arms of the player form an approximate isosceles triangular shape during the swing process.

Further, according to the second preferred embodiment, there are two connection structures which are respectively located on the left and right arms, but the connection structure may be provided only on one of the left and right arms as needed; for example, for a left-handed player, the connection structure may be provided only on the left arm.

Third Embodiment

Figure 3:
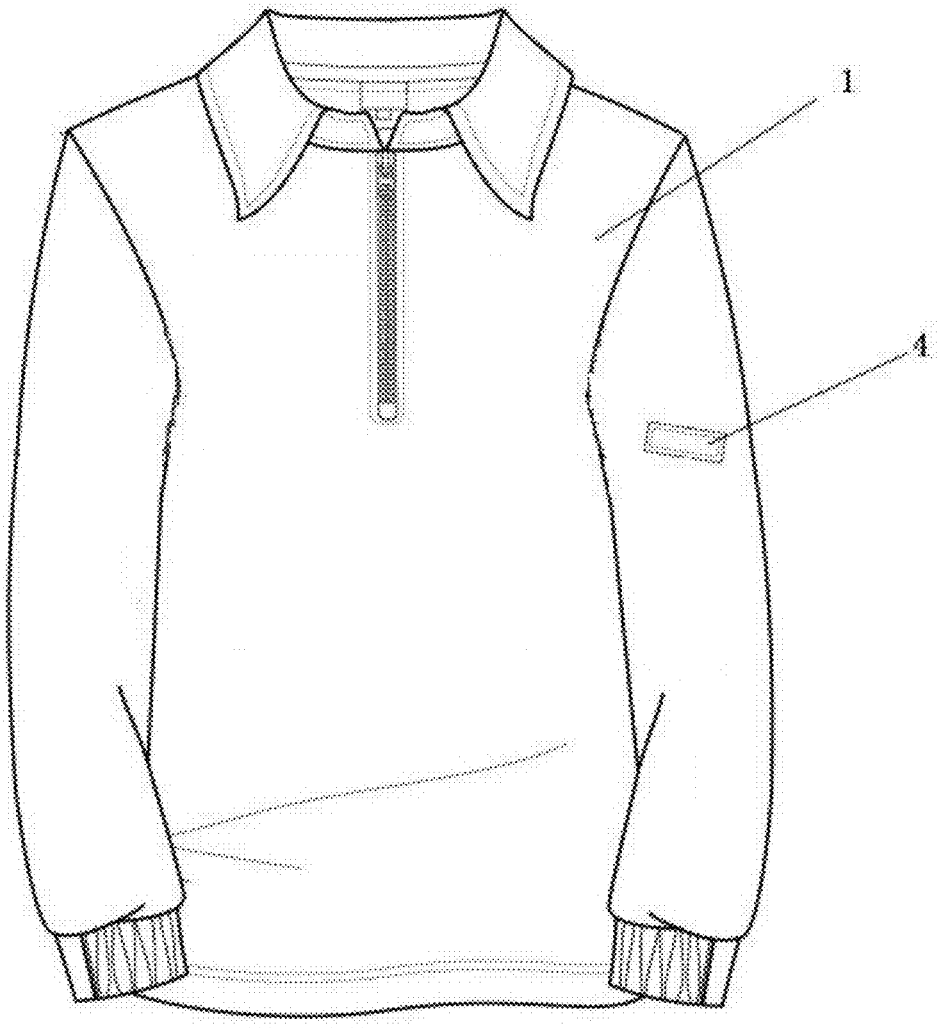
FIG. 3 is a structurally schematic view of a golf clothing with an elbow joint inhibition structure according to a third embodiment of the present invention.

Elbow Joint Inhibition Structure:

FIG. 3 is a structurally schematic view of a clothing according to a third embodiment of the present invention. Referring to FIG. 3, a golf clothing for correcting swing posture in golf sports according to the third embodiment of the present invention is illustrated, which comprises a clothing body 1 and an auxiliary structure for correcting swing posture provided on the clothing body 1. According to the third embodiment of the present invention, the auxiliary structure for correcting swing posture is embodied as an elbow joint inhibition structure 4. As shown in FIG. 3, the elbow joint inhibition structure 4 is located on an arm section of the clothing body 1 which is corresponding to an elbow joint area of a player. More specifically, the elbow joint inhibition structure 4 is located at an inner side of a left-elbow section and/or an inner side of a right-elbow section of the clothing body 1, the elbow joint inhibition structure 4 comprises an insertion part and a rod-shaped hard object to inhibit the elbow joint of the player from bending, wherein the hard object is detachably inserted into the insertion part; when the hard object is inserted into the insertion part on a hitting target-side arm of the player, the hard object limits the elbow joint of the player to bend, so that the arm remains straight, thus a shape formed by the both arms and the shoulder of the player always remains a triangular shape.

More specifically, the insertion part has an insertion port through which the rod-shaped hard object is inserted and an accommodating space for accommodating the hard object, the hard object is limited within the insertion part. The present invention has no limitation on the structure of the insertion part, as long as the hard object is able to be inserted into the insertion part. For example, the insertion part is formed on the clothing body in a form of an inner bag, namely, the accommodating space is formed at an inner side of the clothing body, which means that the insertion part is formed through providing a cloth at an inner side of a sleeve section of the clothing body; also, the insertion part is formed on the clothing body in a form of an outer bag, namely, the accommodating space is formed at an outer side of the clothing body, which means that the insertion part is formed through providing a cloth at an outer side of the sleeve section of the clothing body. The accommodating space may be in a shape of a pocket, or may be formed by multiple through holes, that is, multiple tapes are provided on the sleeve section of the clothing body to form multiple through holes through which the hard object pass.

Figure 4:
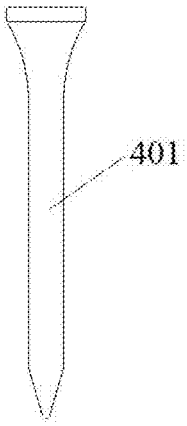
FIG. 4 is a structurally schematic view of an insertion part of the elbow joint inhibition structure according to the third embodiment of the present invention.

The hard object is made from a material with a larger rigidity than the clothing body, such as a rigid material with a certain rigidity. According to the third embodiment, as shown in FIG. 4, the hard object is a golf nail 401 which comprises a flat head portion and a pointed bottom portion, but it is not limited to that, the hard object may be other nail-shaped objects or strip-shaped sheets. When the hard object is inserted into the insertion part, the hard object is approximately parallel to arms of the player 5, so as to block elbows of the player 5 from bending. In the case that the hard object is inserted into the accommodating space through the insertion port of the insertion part, in order to prevent the hard object from falling out of the accommodating space, a cover is provided at the insertion port to seal. The elbow joint inhibition structure 4 is able to be set on one arm section of the clothing body 1, and preferably is set on a left-arm section of the clothing body; of course, is able to be simultaneously set on two arm sections.

When the player wears the golf clothing with the hard object, the hard object extends along an arm length direction of the player and passes through the elbow joint to resist the elbow joint. Therefore, when the player 5 holds a golf club with double fists and performs a regular hitting, one end of the hard object, which extends along an arm length direction of the player and passes through the elbow joint, is against a part of an upper arm of an arm structure of the player, the other end of the hard object is against a part of a lower arm of the arm structure, so as to inhibit a movement of the elbow joint, thereby enabling the player to keep an approximately isosceles triangular shape of the shoulder and the arms during the swing.

Moreover, according to the third embodiment, the hard object is able to be an object with a certain elasticity, such as plastic sheets.

Fourth Embodiment

Figure 5:
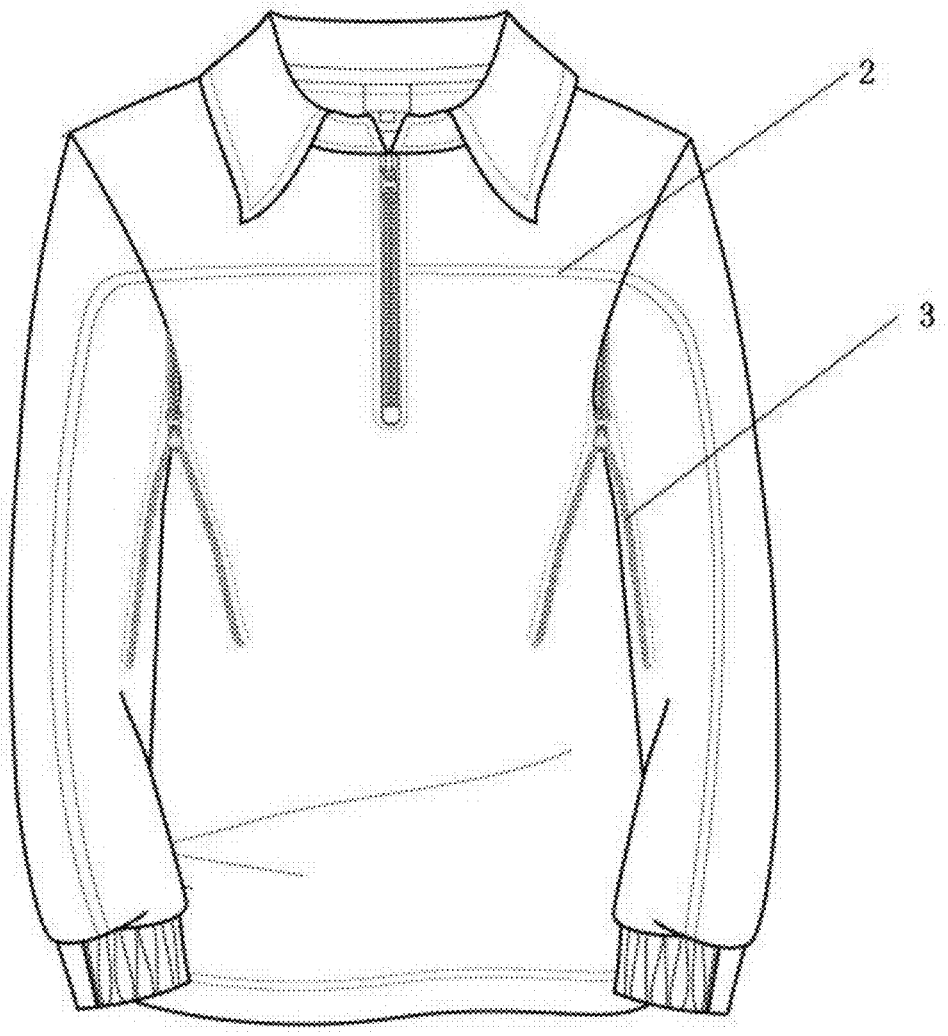
FIG. 5 is a structurally schematic view of a golf clothing with an identification part and a connection structure according to a fourth embodiment of the present invention.

Identification Part+Connection Structure:

FIG. 5 is a structurally schematic view of a clothing according to a fourth embodiment of the present invention. Referring to FIG. 5, a golf clothing for correcting swing posture in golf sports according to the fourth embodiment of the present invention is illustrated. Compared with the golf clothing disclosed by the first embodiment, the auxiliary structure for correcting swing posture comprises a connection structure disclosed by the second embodiment besides a strip identification part 2 disclosed by the first embodiment.

The strip identification part 2 and the connection structure 3 disclosed by the fourth embodiment are respectively as same as the strip identification part 2 disclosed by the first embodiment and the connection structure 3 disclosed by the second embodiment. In order to avoid redundancy, detailed description is omitted here.

Since the golf clothing comprises the strip identification part 2 and the connection structure 3, when the player 5 is exercising, it is optional to use only the strip identification part 2 to keep and correct the swing posture, and at this time, the connecting piece is disconnected with the connected piece of the connection structure 3. It is also possible to use only the connection structure 3 or the identification portion 2 and the connection structure 3 at the same time to keep and correct the swing posture.

Fifth Embodiment

Figure 6:
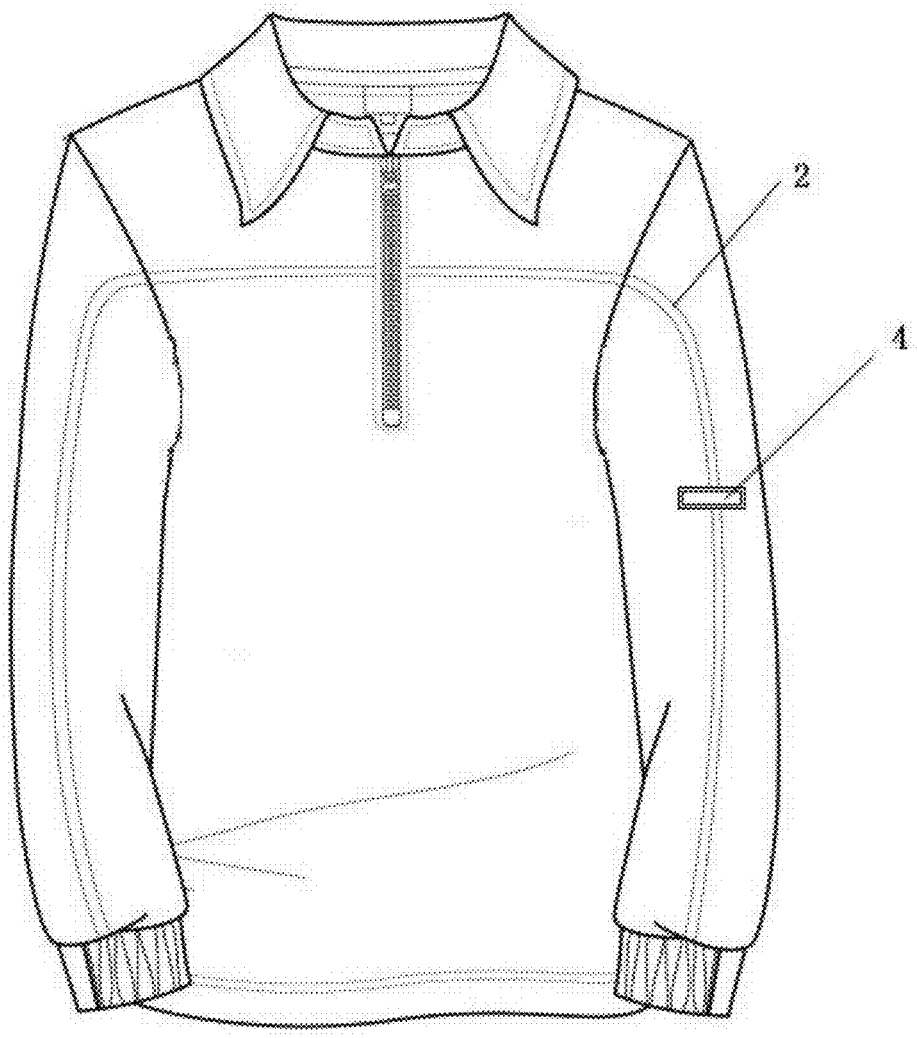
FIG. 6 is a structurally schematic view of a golf clothing with an identification part and an elbow joint inhibition structure according to a fifth embodiment of the present invention.

Identification Part+Elbow Joint Inhibition Structure:

FIG. 6 is a structurally schematic view of a clothing according to a fifth embodiment of the present invention. Referring to FIG. 6, a golf clothing for correcting swing posture in golf sports according to the fifth embodiment of the present invention is illustrated. Compared with the golf clothing disclosed by the first embodiment, the auxiliary structure for correcting swing posture comprises an elbow joint inhibition structure 4 disclosed by the third embodiment besides a strip identification part 2.

The strip identification part 2 and the elbow joint inhibition structure 4 disclosed by the fifth embodiment are respectively as same as the strip identification part 2 and the elbow joint inhibition structure 4 which are disclosed by the first embodiment and the third embodiment. In order to avoid redundancy, detailed description is omitted here.

Since the golf clothing comprises the strip identification part 2 and the elbow joint inhibition structure 4, when the player 5 is exercising, it is optional to use only the strip identification part 2 to keep and correct the swing posture; and at this time, the insertion part is unable to be inserted into the accommodating space. It is also possible to use only the elbow joint inhibition structure 4 or the identification portion 2 and the elbow joint inhibition structure 4 at the same time to keep and correct the swing posture.

Sixth Embodiment

Figure 7:
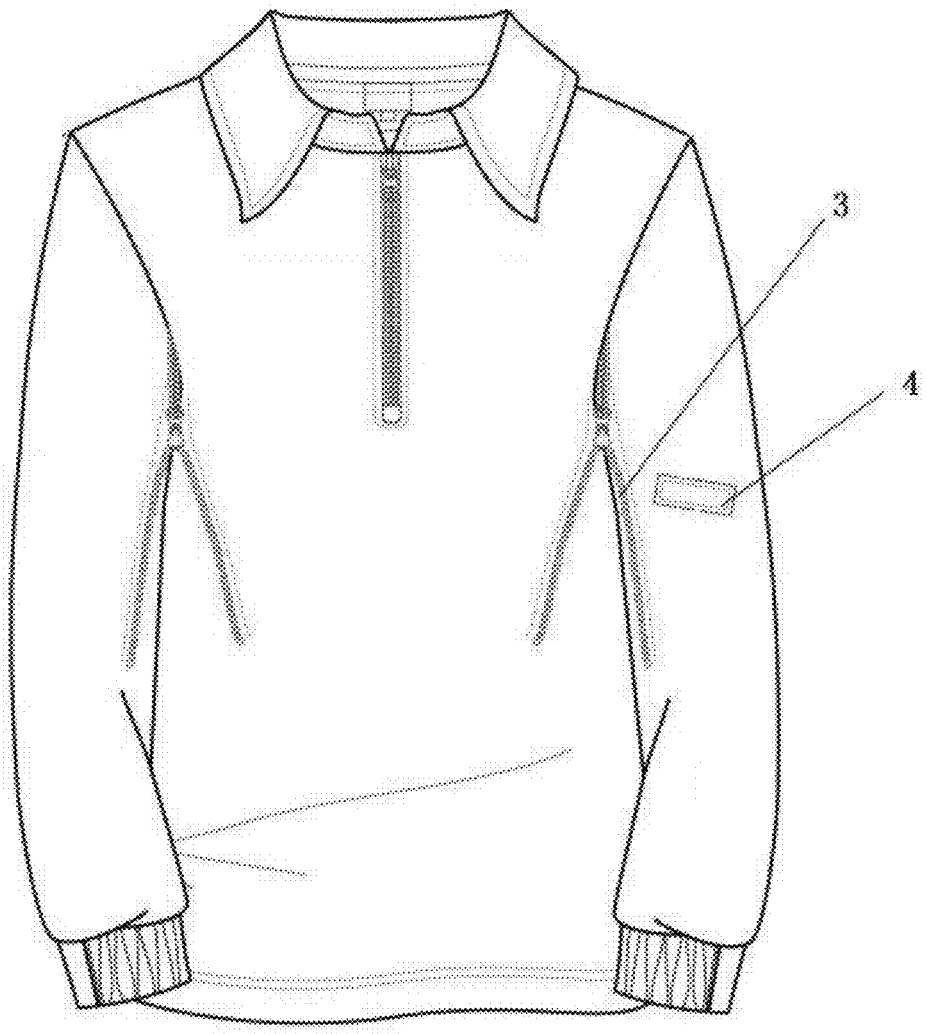
FIG. 7 is a structurally schematic view of a golf clothing with a connection structure and an elbow joint inhibition structure according to a sixth embodiment of the present invention.

Connection Structure+Elbow Joint Inhibition Structure:

FIG. 7 is a structurally schematic view of a clothing according to a sixth embodiment of the present invention. Referring to FIG. 7, a golf clothing for correcting swing posture in golf sports according to the sixth embodiment of the present invention is illustrated. Compared with the golf clothing disclosed by the second embodiment, the auxiliary structure for correcting swing posture comprises an elbow joint inhibition structure 4 disclosed by the third embodiment besides a connection structure 3.

The connection structure 3 and the elbow joint inhibition structure 4 disclosed by the sixth embodiment are respectively as same as the connection structure 3 disclosed by the second embodiment and the elbow joint inhibition structure 4 disclosed by the third embodiment. In order to avoid redundancy, detailed description is omitted here.

Since the golf clothing comprises the connection structure 3 and the elbow joint inhibition structure 4, when the player 5 is exercising, it is optional to use only the connection structure 3 to keep and correct the swing posture; and at this time, the hard object is unable to be inserted into the insertion part. It is also possible to use only the elbow joint inhibition structure 4 or the connection structure 3 and the elbow joint inhibition structure 4 at the same time to keep and correct the swing posture.

Seventh Embodiment

Figure 8:
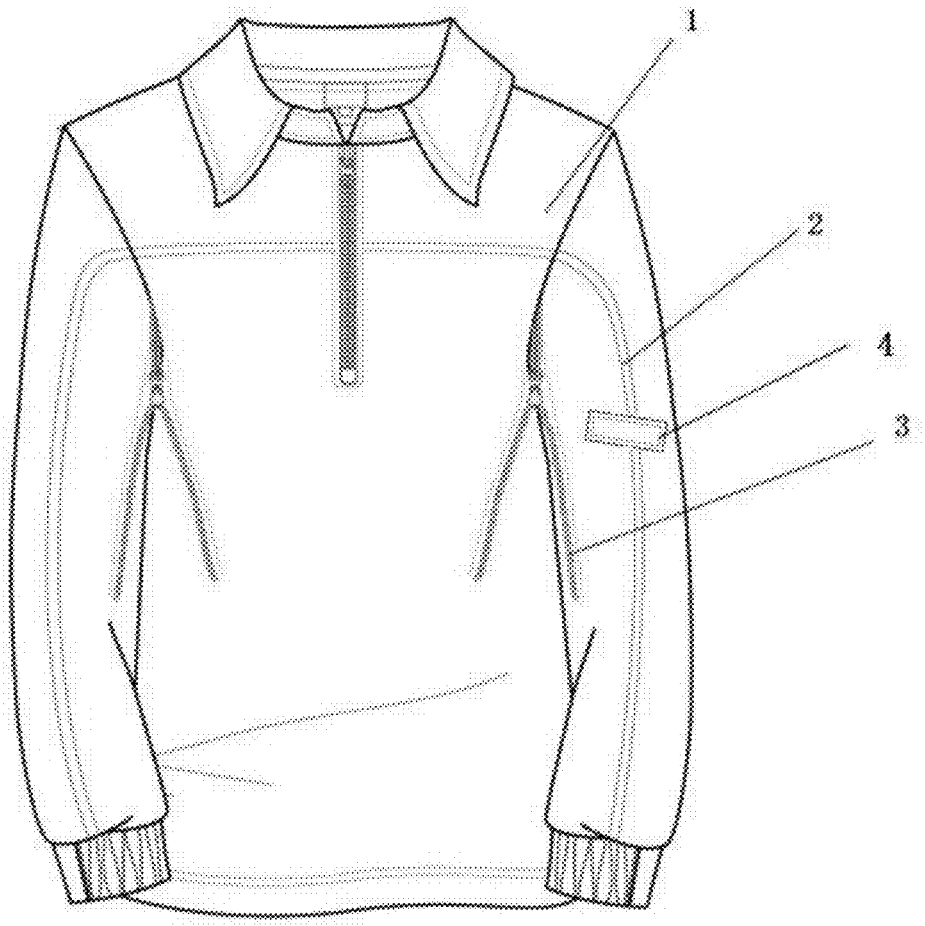
FIG. 8 is a structurally schematic view of a golf clothing with an identification part, a connection structure and an elbow joint inhibition structure according to a seventh embodiment of the present invention.

Identification Part+Connection Structure+Elbow Joint Inhibition Structure:

FIG. 8 is a structurally schematic view of a clothing according to a seventh embodiment of the present invention. Referring to FIG. 8, a golf clothing for correcting swing posture in golf sports according to the seventh embodiment of the present invention is illustrated. Compared with the golf clothing disclosed by the first, second and third embodiments, the auxiliary structure for correcting swing posture disclosed by the seventh embodiment comprises an identification part 2, a connection part 3 and an elbow joint inhibition structure 4.

The identification part 2, the connection structure 3 and the elbow joint inhibition structure 4 disclosed by the seventh embodiment are respectively as same as the identification part 2, the connection structure 3 and the elbow joint inhibition structure 4 disclosed by the first embodiment, the second embodiment and the third embodiment. In order to avoid redundancy, detailed description is omitted here.

Since the golf clothing comprises the identification part 2, the connection structure 3 and the elbow joint inhibition structure 4, when the player 5 is exercising, it is optional to use only the identification part 2 to keep and correct the swing posture; and at this time, the connecting piece is disconnected with the connected piece of the connection structure 3, and the hard object is unable to be inserted into the insertion part. It is also possible to use only the connection structure 3 to keep and correct the swing posture; and at this time, the hard object is unable to be inserted into the insertion part. It is also possible to use only the elbow joint inhibition structure 4 or all of the identification part 2, the connection structure 3 and the elbow joint inhibition structure 4 at the same time to keep and correct the swing posture.

It should be noted that the above embodiments are only used to illustrate the technical solutions of the present invention, and are not limited thereto; although the present invention has been described in detail with reference to the foregoing embodiments, those skilled in the art should understand that the technical solutions described in the foregoing embodiments are able to be modified, or the equivalents of the technical features are able to be replaced. The modifications and substitutions do not depart from the spirit and scope of the technical solutions of the embodiments of the present invention.

What is claimed is:

1. A golf clothing for correcting a swing posture, wherein: the golf clothing comprises a clothing body and an auxiliary structure for correcting swing posture provided on the clothing body, wherein:

the auxiliary structure for correcting swing posture enables a player holding a golf club with double fists for regular hitting to keep a shape formed by both arms and shoulders of the player in a triangular shape during a swing process, and the auxiliary structure for correcting swing posture comprises a strip identification part, wherein:

the strip identification part comprises a shoulder identification section and a double-arm identification section, wherein:

the shoulder identification section transversely extends from a front side of a shoulder section of the clothing body;

the double-arm identification section comprises a left-arm identification subsection and a right-arm identification subsection both of which are respectively connected with two sides of the shoulder identification section and respectively extend along two sleeves of the golf clothing, in such a manner that when the player holds the golf club with double fists to perform a regular hitting preparation posture, a shape which is formed by the shoulder identification section and the double-arm identification section and seen from a perspective of the player is an approximate triangular shape;

the triangular shape is an approximate isosceles triangular shape;

the auxiliary structure for correcting swing posture further comprises a connection structure, wherein:

the connection structure is able to be repeatedly separated and combined, and comprises a left-arm connection substructure and a right-arm connection substructure each of which comprises a connecting piece and a connected piece, wherein:

the left-arm connection substructure is located between an inner side of a left-arm sleeve section and a left side of a chest section of the clothing body, such that the inner side of the left-arm sleeve section tightly clings to the left side of the chest section of the clothing body when the connecting piece and the connected piece of the left-arm connection substructure are connected with each other;

the right-arm connection substructure is located between an inner side of a right-arm sleeve section and a right side of the chest section of the clothing body, such that the inner side of the right-arm sleeve section tightly clings to the right side of the chest section of the clothing body when the connecting piece and the connected piece of the right-arm connection substructure are connected with each other, whereby when the player swings after wearing the golf clothing with the connection structure, due to a limitation of the connection structure, two arms of the player are not easy to bend, thus the shape formed by the both arms and the shoulders of the player keeps the triangular shape.

2. The golf clothing, as recited in claim 1, wherein: the connection structure is a zipper structure.

3. The golf clothing, as recited in claim 2, wherein: the zipper structure comprises two zipper belts which are mated to each other and a slide element connecting the two zipper belts with each other, wherein: a zipper belt located at an inner side of a sleeve section of the clothing body extends from an underarm section to an elbow section of the clothing body, and a zipper belt located at a chest section of the clothing body extends from the under arm section to the chest section in a tilt manner.

4. A golf clothing for correcting a swing posture, wherein: the golf clothing comprises a clothing body and an auxiliary structure for correcting swing posture provided on the clothing body, wherein:

the auxiliary structure for correcting swing posture enables a player holding a golf club with double fists for regular hitting to keep a shape formed by both arms and shoulders of the player in a triangular shape during a swing process, and the auxiliary structure for correcting swing posture comprises a strip identification part, wherein:

the strip identification part comprises a shoulder identification section and a double-arm identification section, wherein:

the shoulder identification section transversely extends from a front side of a shoulder section of the clothing body;

the double-arm identification section comprises a left-arm identification subsection and a right-arm identification subsection both of which are respectively connected with two sides of the shoulder identification section and respectively extend along two sleeves of the golf clothing, in such a manner that when the player holds the golf club with double fists to perform a regular hitting preparation posture, a shape which is formed by the shoulder identification section and the double-arm identification section and seen from a perspective of the player is an approximate triangular shape;

the triangular shape is an approximate isosceles triangular shape;

the auxiliary structure for correcting swing posture further comprises an elbow joint inhibition structure which is located at an inner side of a left-elbow section of the clothing body and/or an inner side of a right-elbow section of the clothing body, wherein: the elbow joint inhibition structure comprises an insertion part and a rod-shaped hard object to inhibit an elbow joint of the player from bending, the hard object is detachably inserted into the insertion part, such that when the hard object is inserted into the insertion part on a hitting target-side arm of the player, the hard object limits the elbow joint of the player to bend for remaining the arm straight, thus a shape formed by the both arms and the shoulders of the player always remains a triangular shape.

5. The golf clothing, as recited in claim 4, wherein: the hard object is a golf nail.

* * * * *